United States Patent [19]

Airy et al.

[11] Patent Number: 5,020,795

[45] Date of Patent: Jun. 4, 1991

[54] PHYSICAL THERAPY AND EXERCISE APPARATUS FOR BODY LIMBS

[75] Inventors: James F. Airy; Thomas D. Kadavy, both of Bellevue, Wash.

[73] Assignee: Soma Dynamics Corporation, Bellevue, Wash.

[21] Appl. No.: 362,887

[22] Filed: Jun. 7, 1989

[51] Int. Cl.[5] ..... A63B 21/005

[52] U.S. Cl. ..... 272/129; 272/130; 272/DIG. 5; 73/379; 128/25 R

[58] Field of Search ..... 272/129, 130, 132, 134, 272/143, DIG. 5, DIG. 6; 128/25 R, 25 B, 774, 782; 73/37 P

[56] References Cited

U.S. PATENT DOCUMENTS

| | | | |
|---|---|---|---|
| 2,777,439 | 1/1957 | Tuttle | 128/25 |
| 3,465,592 | 9/1969 | Perrine | 272/130 X |
| 3,495,824 | 2/1970 | Cuinier | 272/80 |
| 4,235,437 | 11/1980 | Ruis et al. | 272/134 |
| 4,291,787 | 9/1981 | Brentham | 188/318 |
| 4,407,496 | 10/1983 | Johnson | 272/117 |
| 4,436,303 | 3/1984 | McKillip et al. | 272/132 |
| 4,441,708 | 4/1984 | Brentham | 272/130 |
| 4,448,412 | 5/1984 | Brentham | 272/130 |
| 4,493,485 | 1/1985 | Jones | 272/126 |
| 4,601,468 | 7/1986 | Bond et al. | 272/130 |
| 4,609,190 | 9/1986 | Brentham | 272/130 |
| 4,621,807 | 11/1986 | Stramer | 272/117 |
| 4,678,182 | 7/1987 | Nakao et al. | 272/129 X |
| 4,722,525 | 2/1988 | Brentham | 272/130 |
| 4,776,587 | 10/1988 | Carlson et al. | 272/129 |
| 4,823,807 | 4/1989 | Russell et al. | 128/774 X |
| 4,865,315 | 9/1989 | Paterson et al. | 272/130 |
| 4,869,498 | 9/1989 | Wolf et al. | 272/72 X |
| 4,907,795 | 3/1990 | Shaw et al. | 272/134 X |

OTHER PUBLICATIONS

Pamphlet entitled "Loredan Raising Human Potential" by Loredan Biomedical, Inc., 1987.

Pamphlet entitled "Kin-Com The One & Only Complete System!" by Chattecx Corporation, 1988.

Pamphlet entitled "Isokinetic Systems for Testing and Exercise" by Cyb Division of Lumex, Inc., 1988.

*Primary Examiner*—Richard J. Apley

*Assistant Examiner*—Joe H. Cheng

*Attorney, Agent, or Firm*—Christensen, O'Connor, Johnson & Kindness

[57] ABSTRACT

An operating unit (14) is detachably mounted on frame (12) in the form of a chair. The operating unit includes a lever arm assembly (16) mounted on a subframe (18) and rotatable by the leg of the user in opposition to a fluid resistance unit (20). A transducer (24) measures the angular rotation of the lever arm assembly which information is transmitted to an integrated circuit (30) disposed within a portable housing (32) removably mounted on the subframe. The integrated circuit stores the data received from the transducer and calculates various values related to the use of the present invention for presentation on display units (208) and (210). An interface (222) is provided to access the integrated circuit to transmit the stored data to a remotely located data processor (220) and for processing of the data or for long term storage of the data.

19 Claims, 5 Drawing Sheets

Fig. 1.
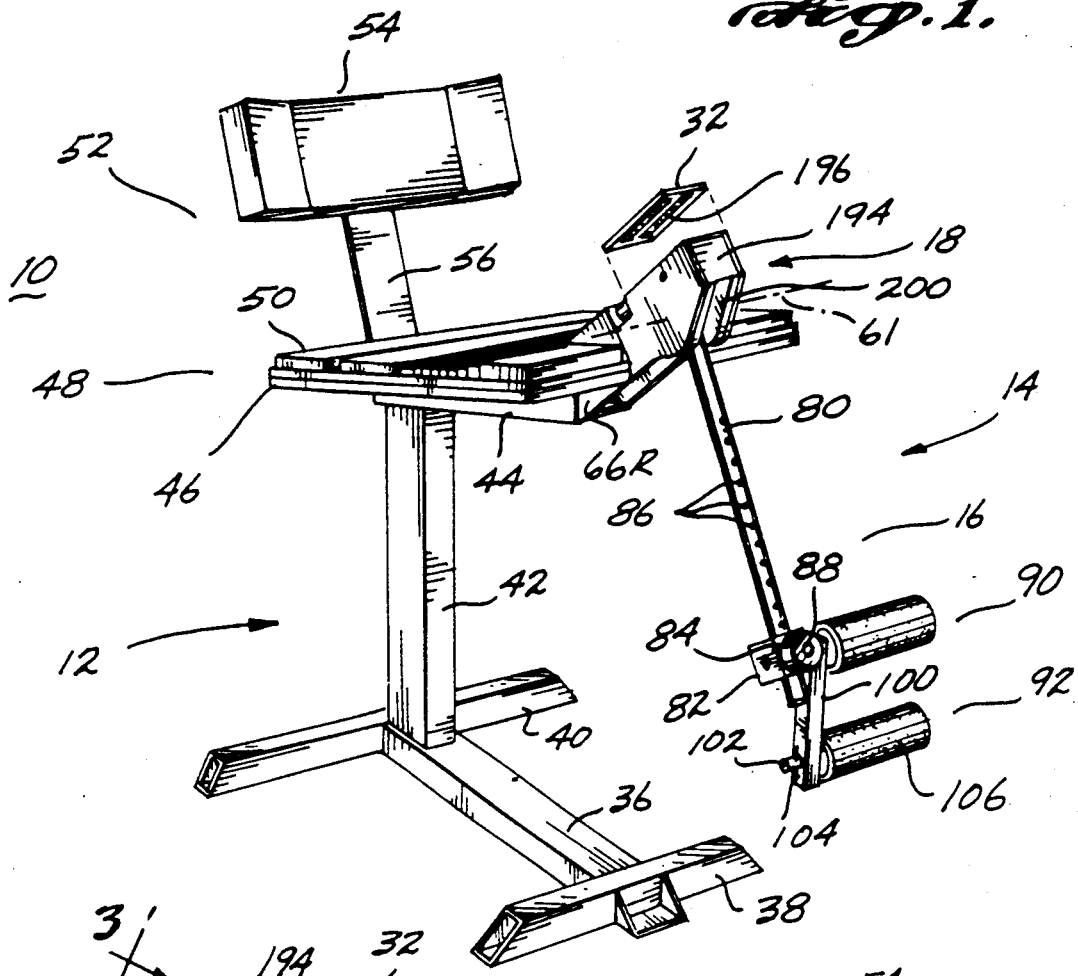
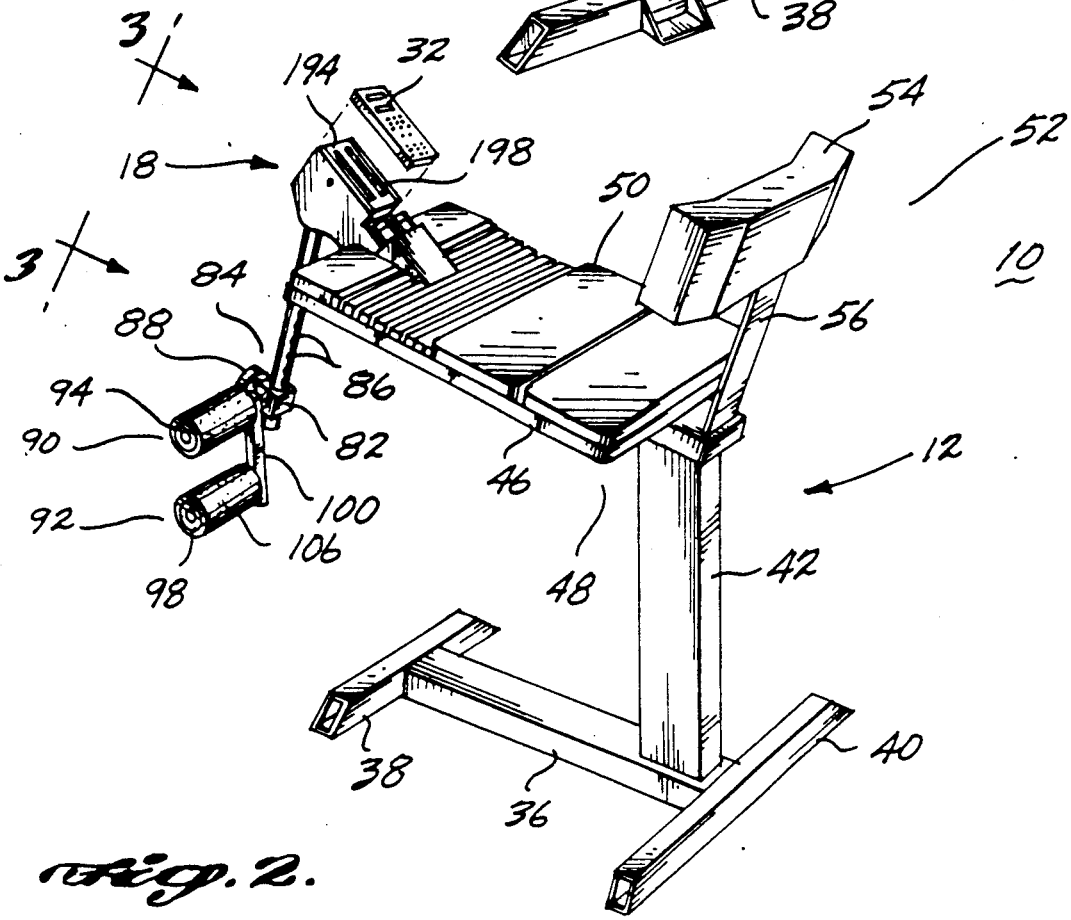
Fig. 2.

PHYSICAL THERAPY AND EXERCISE APPARATUS FOR BODY LIMBS

TECHNICAL FIELD

The present invention concerns rehabilitation and fitness devices, and more particularly, to an apparatus for rehabilitating and exercising the muscles, tendons, ligaments, and other components of a body joint while monitoring the progress of and providing instantaneous feedback to the patient/exerciser.

BACKGROUND OF THE INVENTION

Numerous types of apparatus have been developed for exercising a body joint and the associated muscles, tendons, and ligaments. Typically, such devices are composed of a lever arm having one end pivotally mounted on a stationary frame. The device is operated by the extension or flexion of a body limb pushing or pulling on the opposite end of the lever arm. A resistance device is employed to resist the pivoting movement of the lever arm about the location that the lever arm is mounted on the stationary frame. Examples of such exercise devices are disclosed by U.S. Pat. Nos. 2,777,439, 3,495,824, 4,291,787, 4,407,496, 4,436,303, 4,441,708, 4,448,412, 4,493,485, 4,722,525, 4,600,189, 4,621,807, and 4,666,149.

A significant drawback of many of the foregoing exercise devices is that they are cumbersome, composed of a very large number of components, and too expensive for individuals to purchase for use at home (see, for example, the aforementioned '439, '496, '303, '189, '807, and '149 patents). Another serious drawback of the foregoing exercise devices is that they are designed for use with only one type of body limb and thus, are restrictive in their capabilities. For instance, the devices of the aforementioned '787, '708, '412, '485, '189, '807, '149 patents are only adapted to exercise the user's legs. Further, the foregoing exercise devices do not measure any workout parameters or provide the user with feedback concerning the rehabilitative progress being made by the user.

Specialized diagnostic and physical therapy machines have been developed for rehabilitating an injured body joint. The machines have been designed to control and measure the resistance level imparted against the movement of the body limb about its joint. Such machines may also measure the range of movement of the body joint. Due to their size, cost, and complexity, such machines are not practical for individual ownership, and thus are only available at the facilities of a physical therapist or clinic specializing in sports-related injuries. To use these machines, the patient must leave his place of employment or home to travel to the office or clinic of the therapist or sports medicine doctor. Examples of specialized, stationary machines that have been designed for rehabilitating body joints are disclosed in U.S. Pat. Nos. 3,465,592, 4,601,468, and 4,722,525. Other examples of such machines are marketed by Loredan Biomedical, Inc. of Davis, Calif. under the trademarks LIDO® Active and LIDO® Digital; the Cybex division of Lumex Inc. of Ronkonkoma, N.Y. under Model Cybex 340 and by Chattex Corporation of Chattanooga, Tenn. under the designation KIN-COM®.

SUMMARY OF THE INVENTION

The foregoing drawbacks of known physical therapy machines and exercise devices are addressed by the present invention which provides a combination physical therapy and exercise apparatus having a frame, an actuator mounted on the frame for receiving a portion of the human body, a double acting resistance unit operably interconnected with the actuator to resist the movement of the actuator, and a controller to control the magnitude of the resistance force imposed on the actuator by the resistance unit. The apparatus of the present invention also includes a monitor for measuring at least one parameter related to the use of physical therapy and exercise apparatus, such as the force being exerted by the user during movement of the actuator, the distance through which such force is being exerted, the movement of the actuator, and/or the number of repetitions of the movement of the actuator. The monitor generates a signal corresponding to the parameter being measured for transmission to an integrated circuit disposed in a portable housing mounted on the apparatus frame. The integrated circuit receives signals from the monitoring means and stores data indicative of the signal in an electronic data storage device. An interface is provided for accessing the data storage device to enable the data to be transmitted to a remotely located data processor, for instance, through the use of a modem. Alternatively, the housing for the integrated circuit may be detached from the apparatus frame for convenient transport to the location of the data processor.

In another aspect of the present invention, the integrated circuit itself includes a microprocessor for processing the data from the monitor and the data stored in the storage device to calculate values related to the use of the physical therapy and exercise apparatus. The calculated values may be displayed on a display mounted on the housing of the integrated circuit.

In a further aspect of the present invention, a data input system is associated with the integrated circuit to enable the user to input various factors and data related to the user and the apparatus. Such factors and data may include the physical characteristics of the exerciser, for instance, age, weight and sex of the user. Other information that may be inputted include the configuration of the apparatus, the magnitude of the resistance being imposed on the actuator, and the time.

In accordance with an additional aspect of the present invention, the actuator includes a pivot arm having one end operably interconnected with a pinion gear which is rotatably journaled on a frame. A rack is operably engaged with the pinion gear and also operably connected to the resistance unit which is in the form of a double acting fluid cylinder. A manually manipulative member is mounted on the pivot arm distal from the pinion gear to receive a portion of the human body for pivoting the pivot arm about the rotational access of the pivot gear. A fluid circuit is provided to permit and restrict the passage of the fluid in the cylinder from one side of the piston to the other side, thereby varying the effort required to pivot the pivot arm.

BRIEF DESCRIPTION OF THE DRAWINGS

The details of a typical embodiment of the present invention will be described in connection with the accompanying drawings, in which:

FIG. 1 is a front isometric view of the present invention adapted for use with a knee joint;

FIG. 2 is a rear isometric view of the present invention illustrated in FIG. 1.

DETAILED DESCRIPTION OF THE PREFERRED EMBODIMENT

Figure 3:
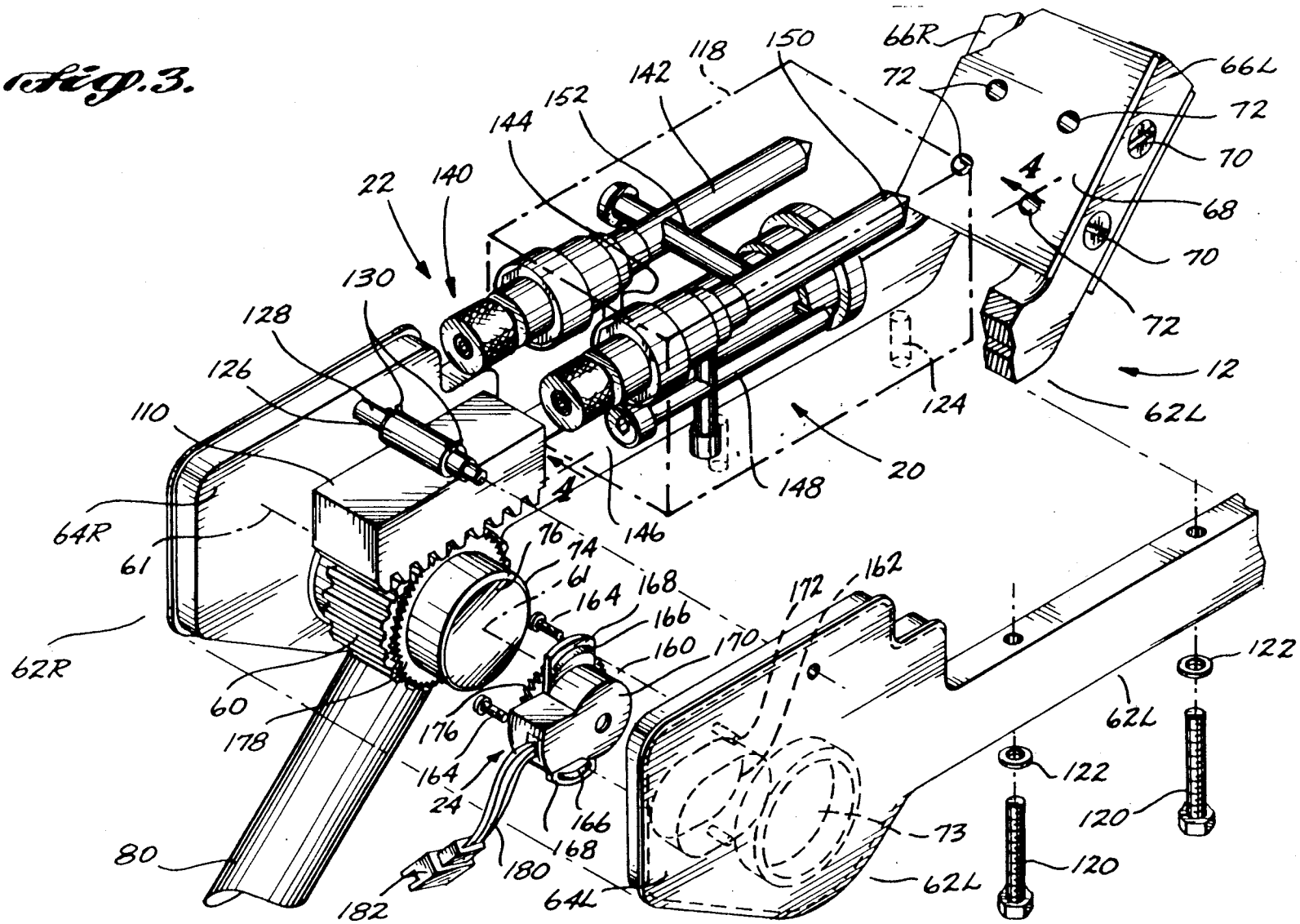
FIG. 3 is an enlarged, fragmentary, isometric view of the present invention taken from line of view 3—3 of FIG. 2 with certain components exploded to more specifically illustrate the construction of the operating unit and with the fluid resistance unit body shown in reference.
Figure 5:
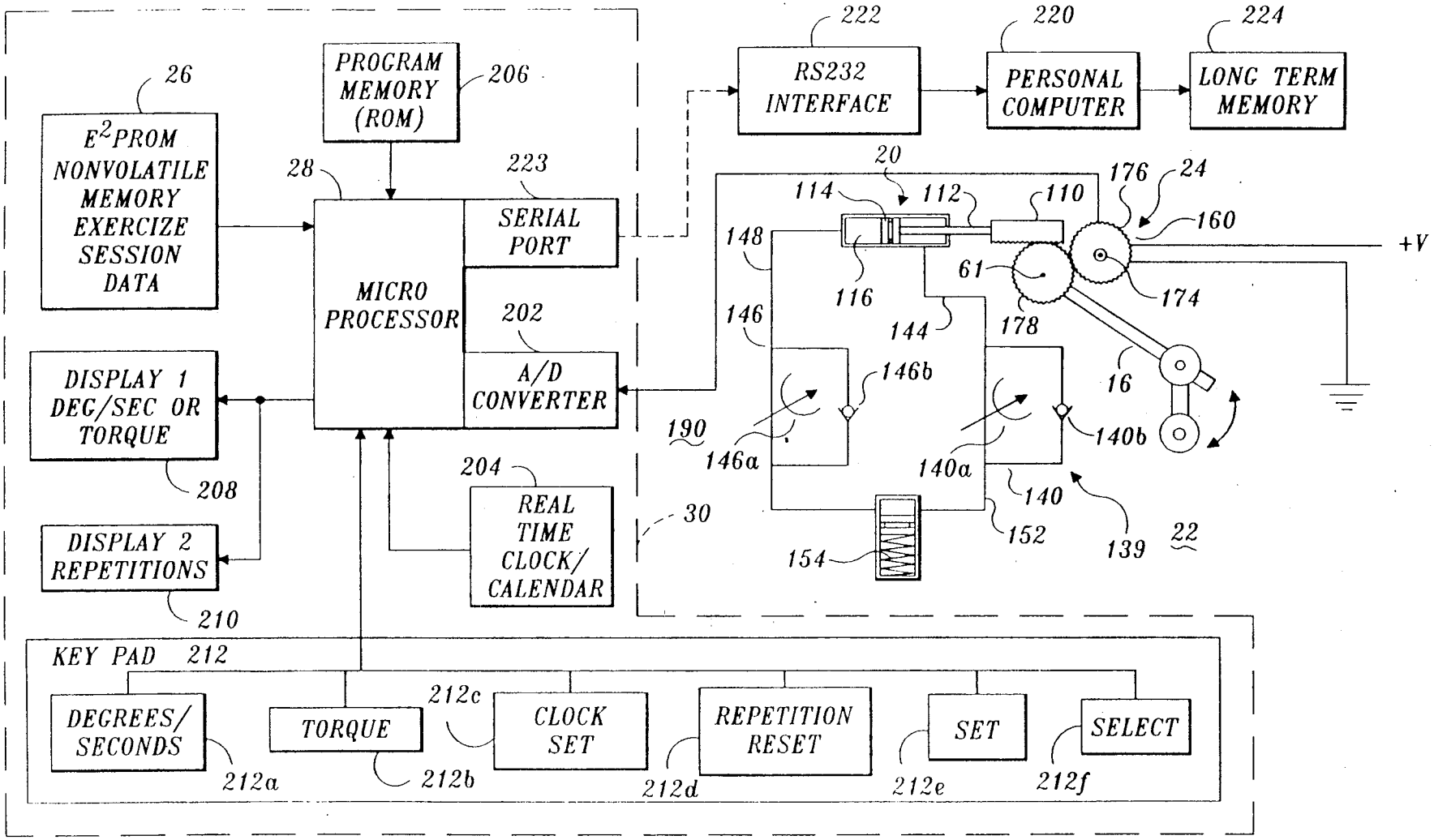
FIG. 5 is a schematic view of the ergometer of the present invention.

Referring initially to FIG. 1, a physical therapy and exercise apparatus 10 is illustrated for use in conjunction with the legs to exercise the muscles, ligaments, tendons and other components of the knee joint. However, it is to be understood that the present invention may be adapted for use in conjunction with other body joints, such as the ankle, shoulder, elbow or wrist. As shown in FIG. 1, in basic form, the apparatus 10 includes a frame structure 12 in the form of a seat unit for supporting the user in a sitting position. An operating unit 14 is detachably mounted on the frame structure 12 and is composed of an actuating mechanism in the form of a lever arm assembly 16 rotatably mounted on a subframe 18 connectable to the frame structure 12. Referring additionally to FIGS. 3 and 5, the operating unit also includes a fluid resistance unit 20 operably interconnected with the lever arm assembly 16 and a control system 22 for controlling the magnitude of a resistance force generated by the fluid resistance unit 20. Continuing to refer to FIGS. 3 and 5, various physical parameters are monitored by a transducer 24 mounted on the subframe 18 including, for instance, the speed at which the body joint is flexed or extended, the effort being expended by the body joint to overcome the resistance unit and the range of movement of the body joint. The data provided by the transducer 24 is transmitted to a data recorder 26 and a microprocessor 28 composing portions of an integrated circuit 30 disposed within a housing 32 detachably mounted on the subframe 18. The data from the transducer 24 is not only stored by the recorder 26 but also used by the microprocessor 28 to calculate in real time various physical values, including the speed of movement of the lever arm assembly, the torque being expended during the movement of the lever arm assembly and the number of cycles that the lever arm assembly is moved when used as an exercise or therapy apparatus. The data recorder and microprocessor units may be interfaced with a remotely located computer system to download the data stored by the integrated circuit 30 and also to utilize this data to analyze the progress of the physical therapy patient/exerciser using more sophisticated techniques than possible with the microprocessor 28.

The following will describe the construction and operation of the physical therapy and exercise apparatus 10 in more detail. In the ensuing description, the terms "forward" or "front" shall correspond to the direction in which the user is facing when sitting on the frame structure 12, whereas the term "rear" shall correspond to the opposite direction.

Referring specifically to FIGS. 1 and 2, the frame structure 12 includes a base composed of longitudinal member 36, a forward transverse member 38 at the front or the longitudinal member, and a rearward transverse member 40 at the rear of the longitudinal member, thereby to define an H-shaped "footprint". A pedestal or post 42 extends upwardly from the rear portion of the longitudinal member 36 to support a forwardly cantilevered seat beam 44. Although the foregoing structural members are illustrated as being composed of rectangular tubular material, it is to be understood that such members may be formed in other cross-sectional shapes, such as square or round, and also formed from other structural members, for instance, solid bars.

The base 46 of a seat 48 is securely mounted on the top of beam 44. The seat 48 also includes a top cushion or pad 50 preferably composed in part of resilient material for the comfort of the person sitting on the seat. A back rest 52 extends upwardly from the post 42 at the rear of the seat 48. The back rest 52 is composed of a padded transverse structure 54 for bearing against the back of the person sitting on the seat 48 and is supported above the seat by a support member 56.

By the foregoing construction the frame structure 12 is capable of supporting the exerciser/physical therapy patient in a safe, stable manner while utilizing his/her legs to operate the lever on assembly 16 as described more fully below. However, it is to be understood that the present invention may be used in conjunction with other types of frame structures, for instance, when desiring to exercise the shoulder, elbow or wrist.

Additionally referring to FIGS. 3 and 5, the operating unit 16 includes a pinion gear 60 mounted on the forward portion of frame structure 12 to rotate about an axis 61. As more clearly shown in FIG. 3, the frame structure 12 includes a pair of spaced apart side plates 62L and 62R having forward cheek plate portions 64L and 64R for supporting the pinion gear 60 and rearwardly extending, elongated, dogleg shaped portions 66L and 66R. A spacer block 68 spans between the rearwardmost portions of the side plates 62L and 62R to maintain the side plates in spaced apart, parallel relationship to each other. To this end, threaded fasteners 70 extend through close-fitting clearance holes formed in the side plate rear portions 66L and 66R to engage within threaded cross holes formed in the spacer block 68. The side plate rear portion 66L and 66R together with the spacer block 68 are adapted to slidably engage within the forward portion of the tubular seat beam 44. Threaded fasteners, not shown, extend upwardly through clearance holes formed in the bottom of the seat beam to engage within aligned threaded holes 72 extending through the thickness of the spacer block 68, see FIG. 3. By this construction, the operating unit 14 may be quickly and conveniently assembled with and disassembled from the frame structure 12, for instance, for use with other frame structures when desiring to exercise other body joints.

As illustrated in FIG. 3, blind bores 73 are formed in the inside faces of the cheek plate portions 64L and 64R for receiving close fitting bushings 74 which in turn are sized to receive stub shafts 76 extending outwardly from the sides of the pinion gear 60. Preferably the bushings 74 are composed of bronze material or other suitable composition to allow the pinion gear 60 to freely rotate relative to the frame structure 12.

Referring specifically to FIGS. 1, 2 and 5, a lever arm assembly 16 is rigidly attached to the pinion gear 60. The lever arm assembly includes a straight, elongated shaft 80 extending radially from the outside diameter of the pinion gear. A collar 82 has a central bore for closely and slidably engaging over the shaft 80. A spring loaded plunger pin assembly 84 is mounted on the collar 82 to engage with a selected circular notch 86 extending along the front and rear portions of the shaft 80. The plunger pin assembly includes an enlarged head portion 88 which may be conveniently manually grasped when desiring to reposition the collar 82 along the length of the shaft 80.

Still referring specifically to FIGS. 1 and 2, a pair of spaced apart rollers 90 and 92 are mounted on the collar 82 for receiving the user's leg therebetween. A shaft 94 is mounted on the collar 82 transversely to the plunger pin 84 to cantilever outwardly from the collar to support the roller 90. Ideally antifriction devices, such as bearings or bushings, not shown, are interposed between the shaft 94 and the roller 90 to permit the roller to rotate freely over the shaft. The second roller 92 is mounted on a shaft 98 which is cantilevered outwardly from the free end of a pivot bar 100, with the opposite end of the pivot bar rotatably mounted on the shaft 94 between the collar 82 and the roller 90. A threaded hardware member 102 extends through one of a series of cross holes 104 formed in the free end portion of the pivot bar 100 to engage within a threaded bore formed in the adjacent end of shaft 98. It will be appreciated that the particular cross hole 104 into which the hardware member 102 extends through will affect the spacing between the rollers 90 and 92 and thus allow the spacing to be changed to accommodate legs or other body limbs of different girths. Ideally, the rollers 90 and 92 are covered with thick resilient padding 106 for the comfort of the exerciser. The padding 106 may be composed of foam rubber or other suitable material.

It will be appreciated by the foregoing construction, that the rollers 90 and 92 may roll along the leg, which is disposed between the rollers, as the leg is being extended or flexed thereby accommodating the fact that a knee joint approximates, but is not exactly analogous to a simple hinge joint. In reality, as the leg is flexed or extended, the anatomical pivot axis of the knee joint moves rearward and forward, respectively, of the leg. Permitting the roller to move along the leg lessens the likelihood that undesirable thrusting loads will be imposed on the knee joint during use of the present invention.

The lower arm assembly 16, as shown in FIGS. 1 and 2, is configured to exercise the left leg. The right leg may be exercised by simply disengaging the plunger pin 84 from the notch 86 at the forward portion of the shaft 90 and rotating the collar 82, 180 degrees so that the plunger pin may be reinserted into a notch 86 at the rearward portion of the shaft. As a result, the rollers 90 and 92 will be positioned to extend transversely from the shaft 80 in the opposite direction as shown in FIGS. 1 and 2.

The effective length of the pivot shaft 80 may be adjusted by shifting the position of the collar 82 along the length of the shaft. As a consequence, the level of effort required to overcome the force of the resistance unit 20; as discussed more fully below, may be adjusted as desired. Also, the shear forces imposed on the knee may be reduced by positioning collar 82 closer to the knee. This is important in early rehabilitation of an injured knee.

The shaft 80 is illustrated in FIGS. 1 and 2 as being composed of a solid rod of circular cross section. It is to be understood that the shaft 80 may be constructed in other cross-sectional shapes, such as square or hexagonal. Also, the rod may be tubular rather than solid in cross section.

Figure 4:
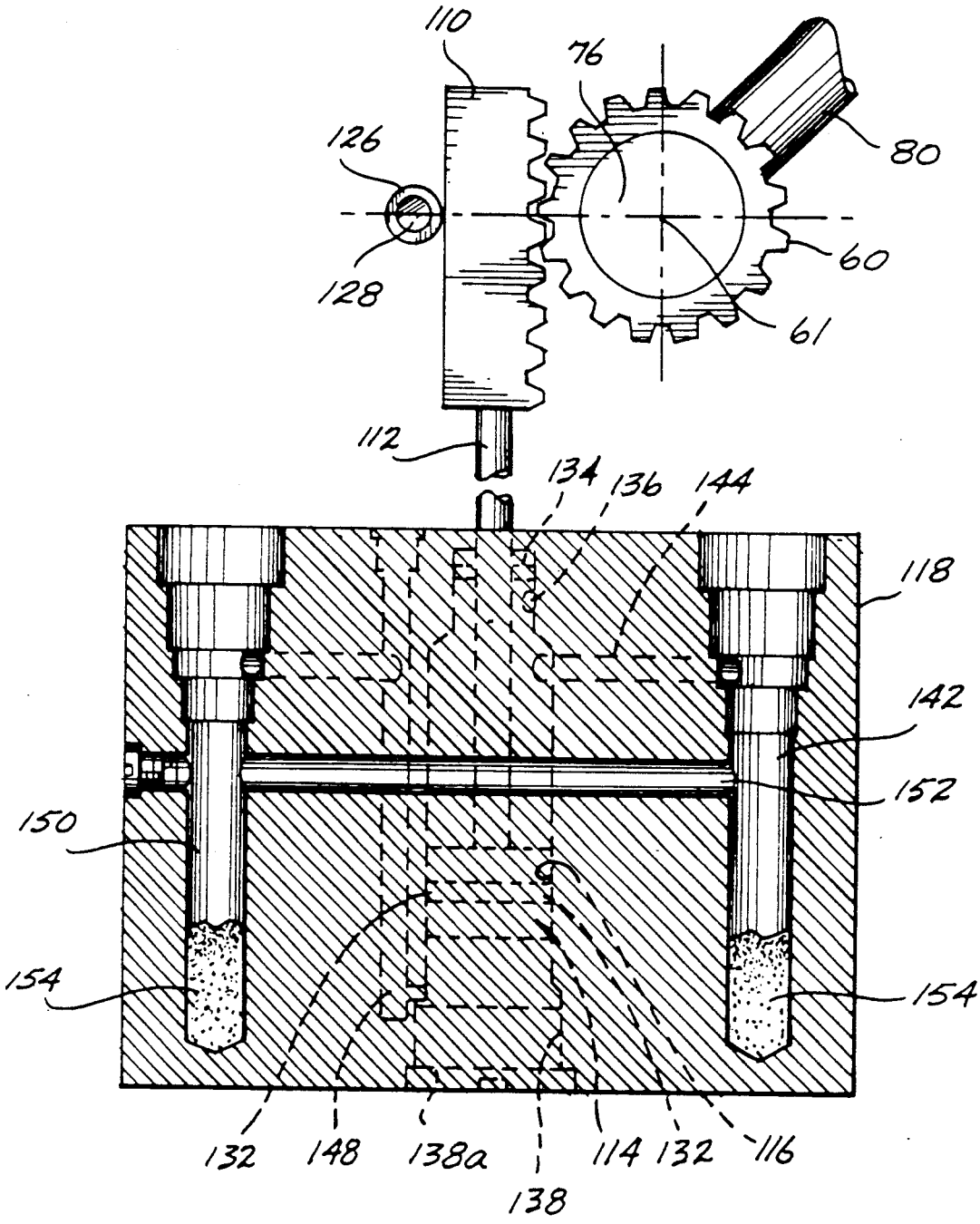
FIG. 4 is an enlarged, fragmentary cross-sectional view taken along line 4—4 of FIG. 3 partially in schematic, with the rack, pinion gear and retaining roller rotated 90° out of the page for clarity, illustrating the construction of the fluid resistance unit and the control system for the resistance unit.

Next referring specifically to FIGS. 3, 4 and 5, an elongate rack 110 is drivingly engaged with the pinion gear 60 and fixedly connected to the outward end of a piston rod 112 which in turn is secured to a piston 114 slidably engaged within a close fitting bore 116 formed in a body 118 mounted on the rearward portions 66L and 66R of the frame structure side plates 62L and 62R, respectively. To this end, threaded fasteners in the form of bolts 120 extend upwardly through locking members in the form of lock washers 122 to extend through clearance openings formed at the side plate rearward portions 66L and 66R to engage with aligned threaded blind holes 124 formed in the underside of the body 118. It will be appreciated that in this manner, the body 118 also serves to maintain the frame side plates 62L and 62R in spaced parallel relationship to each other.

By the foregoing construction, as the lever arm assembly 16 is articulated by the extending and flexing of the user's leg, the pinion gear 60 is rotated about its pivot axis 61 in turn causing the rack 110 to move in the direction longitudinally of the piston rod 112 causing piston 114 to reciprocate within the bore 116. The rack 110 is maintained in engagement with the pinion gear 60 by a retaining roller 126 rotatably journaled on a cross shaft 128 spanning between the cheek plate portions 64L and 64R of the side plates at an elevation above the top of the rack 110 and vertical alignment with the pivot axis 61 of the rack 110. By this construction, the retaining roller rides over the top flat surface of the rack 110 as the rack is reciprocated back and forth by the rotating pinion gear 60. As shown in FIG. 3, the retaining roller 126 is positioned longitudinally on the cross shaft 128 by a pair of retaining members in the form of snap rings 130 engaged within close fitting grooves extending around the circumference of the cross shaft.

As most clearly shown in FIG. 4, a seal 132 is disposed within a close fitting groove circumferentially extending around the piston 114 to help prevent leakage of fluid within the bore 116 as a piston reciprocates back and forth. Also, a lip seal 134 is disposed within a counterbore 136 formed in the end of the bore 116 adjacent the rack 110, thereby preventing the fluid within the bore 116 from leaking past the piston rod 112. It will be appreciated that the bore 116 and counterbore 136 may be conveniently formed during the same machining operation by an appropriate boring or similar tool entering the body 18 from the direction opposite the counterbore 136. An enlarged counterbore 138 is formed at the end of the bore 116 opposite the smaller counterbore 136, which larger counterbore is threaded to receive a plug **138*a* to close off the bore 116**.

As shown most clearly in FIGS. 3–5, the apparatus 10 includes a control system 22 for varying the magnitude of the resistance generated by the fluid resistance unit 20. The control system 22 includes a hydraulic circuit 139 composed of a valve assembly 140 disposed within the forward enlarged portion of a longitudinal valve bore 142 extending rearwardly through the body 118 at an elevation above and to the right of the piston bore 116. The valve assembly 140 includes a flow control valve component 140*a* disposed in fluid flow communication with the portion (front portion) of the piston bore 116 adjacent the rack 110 by a fluid passageway 144. The piston bore 116 on the opposite side of the piston 114 (rear side) is connected in fluid flow communication with the flow control valve component 146*a* of a second flow control valve assembly 146 engaged within an elongated valve bore 150 disposed in space, parallel relationship with the valve bore 142. The rear portion of the piston bore 116 is connected with the valve bore 150 by a fluid passageway 148. The flow control valves 140*a* and 146*a*, located at opposite sides of the piston bore 116 are interconnected in fluid flow communication by a transverse passageway 152.

As illustrated in FIGS. 3 and 4 and schematically shown in FIG. 5, the distal ends of the valve bores 142 and 150 serve as reservoirs or accumulation chambers for the fluid utilized in the resistance unit 20 and control system 22 and to adjust for the varying volume of fluid within the piston bore 116 due to the volume of the piston rod. The accumulator is illustrated schematically in FIG. 5 as 154. Ideally, compressible, closed cell foam material is disposed within the ends of the valve bores 142 and 150 to maintain a positive pressure on the fluid within the hydraulic circuit 139.

As illustrated schematically in FIG. 5, the valve assemblies 140 and 146 also include integral check valves 140*b* and 146*b*. The check valve 140*b* prevents fluid flow from the forward end of the piston bore 116 to the opposite end of the piston bore except through flow control valve 140*a* while permitting fluid from the rear end of the piston bore that passes through flow control 146*a* to freely flow into the forward end of the piston bore. As will be appreciated, the check valve 146*b* functions in an analogous manner with respect to flow control valves 146*a* and 140*a*. Combination flow control and check valve assemblies or cartridges, such as assemblies 140 and 146 are standard articles of commerce, for instance, valve model FC10-20 manufactured by HydraForce, Inc. of Northbrook, Ill.

It will be appreciated that by the foregoing construction, the flow control valve 140*a* may be adjusted to control the flow of fluid exiting the forward end of the piston bore 116 as piston 114 travels forwardly in response to the rotation of the lever arm assembly 16 in the clockwise direction about axis 61 as viewed in FIG. 1. Correspondingly, the flow control valve 146*a* may be adjusted to control the resistance imposed on the piston 114 in its rearward travel along the piston bore 116 and, thus, the rotational movement of the lever arm assembly 16 in the counterclockwise direction as viewed in FIG. 1.

The physical therapy and exercise apparatus 10 of the present invention is configured to measure various parameters associated with the use of the apparatus such as the range of motion of the body joint, the speed at which the body joint is flexed and extended, and the torque being inserted by the body joint when pivoting the lever arm assembly 16. To this end, a transducer 24 in the form of a potentiometer 160 is mounted in a cavity 162 formed in the inside surface of the forward cheek plate portion 64L of the side plate 62L. The potentiometer 160 is held in place by a pair of threaded fasteners in the form of screws 164 extending through arc-shaped slots 166 formed in upper and lower flanges 168 extending upwardly and downwardly from the body portion 170 of the potentiometer. The slots 166 enable the potentiometer to be rotatably positioned to coincide with the desired nominal or "zero" position of the lever arm assembly 16. The screws 164 engage within aligned, threaded blind holes 172 formed in the cheek plate portion 64L. The potentiometer 160 includes an input shaft 174 on which is mounted a thin spur gear 176 which meshes with a corresponding thin spur gear 178 securely engaged over the adjacent stub shaft portion 76 of the pinion gear 60. As the spur gear 178 is rotated by the movement of the pinion gear, the spur gear 176 is rotated through a corresponding angle thereby producing a change in the electrical signal produced by the potentiometer 160 and outputted through a ribbon bus 180 having a snap connector 182 attached to the distal end thereof. Potentiometers, such as potentiometer 160, are articles of commerce, for instance, model No. CP10 manufactured by Colbern, a division of Crystalate Electronics Ltd. of Essex, England.

As illustrated in FIG. 5, the physical therapy and exercise apparatus 10 of the present invention may be utilized as a component of an ergometer 190 to calculate the work being expended by the exerciser, as well as other parameters, thereby to monitor the progress of the rehabilitation or exercise program and provide instantaneous feedback to the user. In the ergometer, the output signal from the transducer 24 is transmitted to an integrated circuit 30 located within a small, portable hand-held housing 32 detachably mountable on a formed cover 194 spanning between the top and forward portions of cheek plate portions 64L and 64R of the side plates 62L and 62R. The housing 32 may be detachably mounted on the cover 194 by any convenient means, for instance, through the use of strips or patches of looped nap 196 mounted on the underside of the housing 32 to engage with corresponding strips or patches of hooked nap 198 mounted on the upper surface of the cover 194. The looped nap strips or patches 196 and the hooked nap strips or patches 198 may be formed for various types of materials, such as nylon. One such type of looped and hooked nap nylon materials which may be employed with the present invention is sold under a trademark VELCRO. As illustrated in FIG. 1, the portion of the cover extending over the forward portions of the cheek plate portions 64L and 64R includes a central slot 200 for providing clearance for the shaft 80 of the lever arm assembly 16. The snap connector 182 of the transducer 24 is detachably connectable with a matching connector portion integrated into the construction of the housing 32.

Referring specifically to FIG. 5, the integrated circuit 30 includes a microprocessor 28 and an A/D converter 202 disposed between the microprocessor 28 and the transducer 24. The integrated circuit also includes a memory unit 26, which preferably is composed of an EEPROM for storing the data received from the transducer 24. The integrated circuit also includes a real time clock and calendar 204 for use in analyzing the data from the transducer 24 as a function for time, for instance, to calculate the relative speed of movement of the lever arm assembly 16 about the pivot axis 61 under the control of a program stored in a memory unit 206, preferably in the form of a ROM. Another value that may be calculated by the ergometer 190 of the present invention is the torque being expended by the user when pivoting the lever arm assembly 16. This information, as well as the speed at which the lever arm assembly 16 is pivoted, is transmitted to the user on a display 208. Other information, such as the number of cycles that the present invention has been used, may be determined by the microprocessor 28 and transmitted to the user in a second display 210.

The particular calculations made by the ergometer 190 and displayed on the displays 208 and 210 may be controlled by the user by operation of a keypad 212 having various pressure actuated switches 212*a*, 212*b*, 212*c*, 212*d*, 212*e*, and 212*f*, as illustrated in FIG. 5. The switch 212*a* is depressed when desiring to show the speed of rotation of the lever arm assembly 16 about the pivot axis 61 on the display 208, whereas switch 212*b* is depressed when desiring to show the torque being expended by the user of the apparatus 10. Switch 212*c* is utilized when setting the clock/calendar 204 to correct the time. Switch 212*d* is depressed when resetting the display 210 which shows the number of repetitions that the exerciser or physical therapy patient has accomplished. The "select" and "set" switches 212*f* and 212*e* are used to input various factors or information that is used in the calculations performed by the microprocessor 28. This information may include, for instance, the position of the collar 82 along the shaft 80 which is indicative of the length of the moment arm of the lever arm assembly 16, whether the right or left limb is being exercised, the identity (name) of the user of the apparatus 10, the sex and age of the user, etc.

Periodically, the integrated circuit 30 may be interfaced with a personal computer 220 through an appropriate interface 222 connected to a serial port 223 of the integrated circuit to download the information stored in the memory unit 26 for long-term storage of this data on a different type of memory device 224, such as a floppy or hard disk. In addition, the data transferred from the memory unit 26 may be analyzed with the computer 220 using more sophisticated techniques then capable with the microprocessor 28, thereby to monitor the rehabilitative process of the patient or to monitor the progress of the exercise regime being undertaken by the user.

It will be appreciated that by incorporating the integrated circuit 30 into a small, portable housing 32, the present invention may be utilized at virtually any location and the data recorded and simultaneously initially analyzed by the ergometer 190 and then later analyzed by a larger processor located at a remote stationary location, for instance, at the office of a physical therapist or doctor. However, the serial port 223 may be connected to a modem so that the data being transmitted to the integrated circuit 30 from the transducer 24 may be transmitted in real time to the remotely located computer 220 for immediate analysis of the data being received.

It is to be appreciated that the integrated circuit 30 may be utilized not only with the transducer 24 shown in FIGS. 3 and 5, but also with other known types of transducers, which may be incorporated into the present invention. Such transducers may include, for instance, a wheat stone bridge or an "electric eye."

Figure 6:
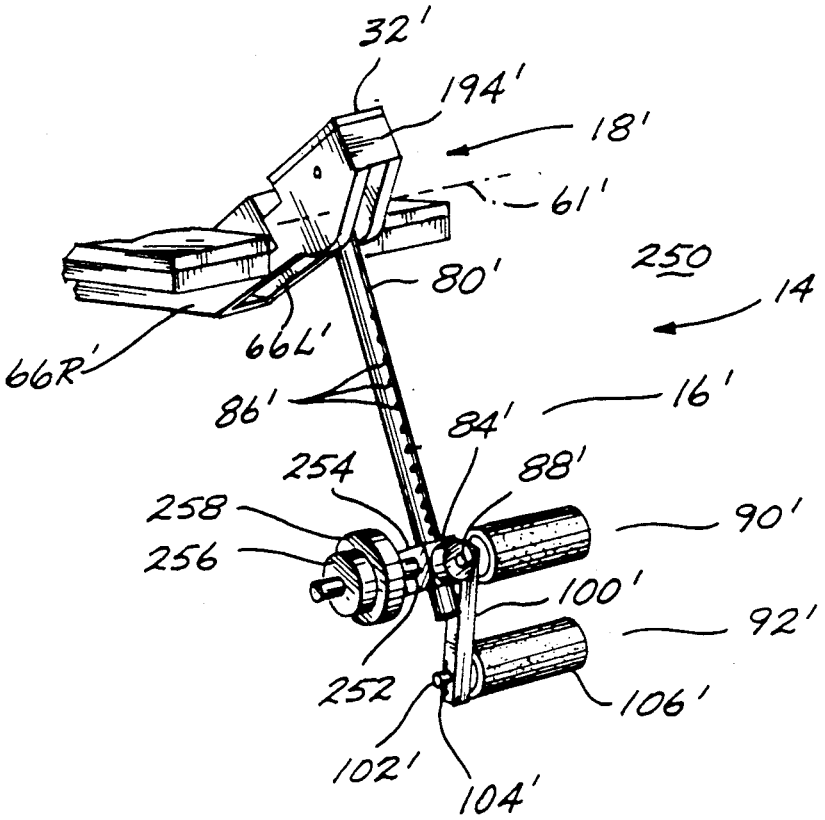
FIG. 6 is a fragmentary isometric view of an alternative embodiment of the present invention.

An alternative preferred embodiment of the present invention is illustrated in FIG. 6, illustrating a physical therapy and exercise apparatus 250 which is constructed essentially identically with apparatus 10, but with the addition of a weight receiving bar 252 cantilevered transversely outwardly from a collar 254 in a direction opposite to roller 90'. The bar 252 is adapted to receive weights, for instance, disk weights 256 and 258, having central openings for engaging over the bar 252. In all other respects, preferably apparatus 250 is constructed identically with the apparatus 10. Accordingly, the components of the apparatus 250 shown in FIG. 6 that correspond to the components of apparatus 10 shown in FIGS. 1–5, have been given the same part number but with a prime (') designation.

An advantage of the apparatus 250 is that it may be used to perform eccentric exercises, i.e., resisting a load during the elongation of muscles, i.e., the hamstrings. Eccentric exercise of muscles is important since muscles are commonly used in an eccentric mode. To use apparatus 250 to eccentrically exercise the hamstrings, the fluid resistance unit 20 is adjusted so as to not impede the rotation of lever arm assembly 16. The hamstring muscles are concentrically exercised by extending the leg and thus contracting the hamstring muscles to thereby lift the weights 256 and 258 upwardly. The hamstring muscles are then extended (eccentrically exercised) by slowly flexing the leg to lower the weights.

As will be apparent to those skilled in the art to which the invention is addressed, the present invention may be embodied in forms other than those specifically disclosed above, and may be adapted for use with other body joints, such as the ankle, elbow, or wrist joints without departing from the spirit or scope of the present invention. The particular embodiments of the physical therapy and exercise apparatus 10 and 250 set forth above, is therefore to be considered in all respects as illustrative and not restrictive. The scope of the present invention as set forth in the appended claims rather than being limited to the examples of the physical therapy and exercise apparatus 10 and 250 set forth in the foregoing description.

The embodiments of the invention in which an exclusive property or privelege is claimed are defined as follows:

1. A physical therapy and exercise apparatus, comprising:

(a) a frame;

(b) actuating means mounted on the frame for movement by a portion of a user's body;

(c) double acting resistance means operably interconnected with the actuating means to resist movement of the actuating means, the resistance means including control means to control the magnitude of the resistance force imposed on the actuating means by the resistance means;

(d) means for monitoring at least one parameter related to the use of the physical therapy exercise apparatus and providing a corresponding signal;

(e) integrated circuit means having signal receiving means for receiving the signals from the monitoring means, data storage means for storing the data indicative of the signal received by the integrated circuit means from the monitoring means and interface means for accessing the data storage means to transmit the data to a remotely located data processor for further processing the data, wherein the integrated circuit means is disposed within a portable first subassembly detachably mounted on the frame; and, (f) means for detachably mounting the portable first subassembly on the frame for convenient removal from the frame.

2. The apparatus according to claim 1, wherein the integrated circuit means further includes processing means for further processing the signals and the stored data to calculate values related to the use of the physical therapy and exercise apparatus.

3. The apparatus according to claim 2, further comprising a display mounted on the portable first subassembly for displaying the values computed by the integrated circuit means.

4. The apparatus according to claim 1, further comprising data input means operably associated with the integrated circuit means to enable the user to manually input factors and data selected from the group consisting of the physical characteristics of the exerciser, the configuration of the physical therapy and the exercise apparatus, the magnitude of the resistance force being imposed on the actuating means, and the time.

5. The apparatus according to claim 1, wherein the actuating means comprises:

(a) a pivot arm having one end portion operably interconnected with a pinion gear rotatably mounted on the frame;

(b) a rack operably engaged with the pinion gear and operably connected with the resistance means; and, (c) a manually manipulable member mounted on the pivot arm distal from the pinion gear to receive a portion of the user's body for pivoting the pivot arm about the rotational axis of the pinion gear.

6. The apparatus according to claim 1, wherein the resistance means comprises:

a fluid cylinder;

a piston slidably disposed within the cylinder and operably connected to the actuating means; and fluid circuit means to permit passage of fluid in the cylinder from one side of the the piston to the other side of the piston.

7. The apparatus according to claim 6, wherein the control means includes means for selectively restricting the flow of the fluid in the cylinder from one side of the piston to the opposite side of the piston.

8. The apparatus according to claim 1, further comprising:

a second assembly composed of the actuating means, the resistance means and the control means;

a second subassembly frame on which the second assembly is mounted; and, means for detachably mounting the second subassembly frame on the frame.

9. The apparatus according to claim 8, wherein the integrated circuit means is also mounted on the second subassembly frame.

10. A physical therapy and exercise apparatus, comprising:

(a) a frame;

(b) actuating means mounted on the frame for movement by a portion of a user's body;

(c) double acting resistance means operably interconnected with the actuating means to resist movement of the actuating means, the resistance means including control means to control the magnitude of the resistance force imposed on the actuating means by the resistance means;

(d) means for monitoring at least one parameter related to the use of the physical therapy and exercise apparatus and providing a corresponding signal;

(e) integrated circuit means having signal receiving means for receiving the signals from the monitoring means, data storage means for storing the data indicative of the signal received by the integrated circuit means from the moitoring means and interface means for accessing the data storage means to transmit the data to a remotely located data processor to proces the data;

(f) wherein the actuating means comprises:

(i) a pivot arm having one end portion operably interconnected with a pinion gear rotatably mounted on the frame;

(ii) a rack operably engaged with the pinion gear and operably connected with the resistance means; and, (iii) a manually manipulable member mounted on the pivot arm distal from the pinion gear to receive a portion of the user's body for pivoting the pivot arm about the rotational axis of the pinion gear;

(g) wherein the resistance means comprises:

(i) a fluid cylinder;

(ii) a piston slidably disposed within the cylinder and operably connected to the rack; and (iii) fluid circuit means to permit passage of fluid in the cylinder from one side of the piston to the other side of the piston;

(h) wherein the control means includes means for selectively restricting the flow of the fluid in the cylinder from one side of the piston to the opposite side of the piston; and, (i) wherein the cylinder is formed within a block structure and the fluid circuit means includes passageways formed in the block structure.

11. The apparatus according to claim 10, further including an accumulator for the fluid of the fluid circuit means.

12. A physical therapy and exercise apparatus, comprising:

(a) a frame;

(b) actuating means mounted on the frame for movement by a portion of a user's body;

(c) double acting resistance means operably interconnected with the actuating means to resist movement of the actuating means the resistance means including control means to control the magnitude of the resistance force imposed on the actuting means by the resistance means;

(d) means for monitoring at least one parameter related to the use of the physical thereapy and exercise apparatus and providing a corresponding signal;

(e) integrated circuit means having signal receiving means for receiving the signals from the monitoring means data storage means for storing the data indicative of the signal received by the integrated circuit means from the monitoring means and interface means for accessing the data storage means to transmit the data to a remotely located data processor to process the data;

(f) a second subassembly composed of the actuating means, the resistance means and the control means;

(g) a second subassembly frame on which the second subassembly is mounted;

(h) means for detachably mounting the second subassembly frame on the apparatus frame;

(i) wherein the integrated circuit means is also mounted on the second subassembly frame; and, (j) further including means for detachably mounting the integrated circuit means on the second subassembly frame.

13. A physical therapy and exercise apparatus having actuating means moveable by a portion of a user's body, resistance means to resist movement of the actuating means including control means to control the magnitude of the resistance force imposed on the actuating means by the resistance means, and further comprising:

(a) means for monitoring at least one parameter related to the use of the physical therapy and exercise apparatus and providing corresponding signals;

(b) integrated circuit means disposed within a portable housing, the integrated circuit means having signal receiving means for receiving the signals from the monitoring means data storage means for storing data indicative of the signals received from the monitoring means, and interface means for accessing the data storage means to transmit the data to a data processor for further processing the data; and, (c) means for detachably mounting the portable housing on the physical therapy and exercise apparatus for convenient removal and transportation independently of the remainder of the physical therapy and exercise apparatus.

14. The apparatus according to claim 13, wherein the intergrated circuit means further includes processing means for further processing the data being received from the monitoring means and the data stored in the data storage means to calculate values related to the use of the physical therapy and exercise apparatus.

15. The apparatus according to claim 14, further comprising display means mounted on the portable housing for displaying the values computed by the integrated circuit means.

16. The apparatus according to claim 13, further comprising data input means operably associated with the integrated circuit means to enable the user to manually input factors and data selected from the group consisting of the physical characteristics of the exerciser, the configuration of the physical therapy and exercise apparatus, the magnitude of the resistance force being imposed on the actuating means and the time.

17. The apparatus according to claim 13, wherein the physical parameters being measured are selected from the group consisting of the force being exerted during movement of the actuating means, the distance moved by the actuating means while the force is being exerted, the degree of movement of the actuating means and the number of repetitions of movement of the actuating means.

18. The apparatus according to claim 13, wherein the actuating means comprises:

(a) a pivot arm having one end portion operably connected with a rotatable pinion gear assembly;

(b) a rack operably engaged with the pinion gear assembly and operably connected with the resistance means; and, (c) a manually manipulative member mounted on the pivot arm distal from the pinion gear to receive the portion of the user's body for pivoting the pivot arm about the rotational axis of the pinion gear and thereby moving the rack relative to the resistance means.

19. The apparatus according to claim 13, further comprising:

(a) an apparatus frame for supporting the apparatus;

(b) a subassembly composed of the actuating means, the resistance means, the control means and a subframe on which the subassembly is mounted; and, (c) means for detachably mounting the subframe on the apparatus frame.

* * * * *